US010842239B2

(12) United States Patent
Miller-Johnson

(10) Patent No.: US 10,842,239 B2
(45) Date of Patent: Nov. 24, 2020

(54) DETANGLING HAIR COMB

(71) Applicant: Shirley Miller-Johnson, Memphis, TN (US)

(72) Inventor: Shirley Miller-Johnson, Memphis, TN (US)

( * ) Notice: Subject to any disclaimer, the term of this patent is extended or adjusted under 35 U.S.C. 154(b) by 231 days.

(21) Appl. No.: 15/900,424

(22) Filed: Feb. 20, 2018

(65) Prior Publication Data

US 2018/0168313 A1 Jun. 21, 2018

Related U.S. Application Data

(63) Continuation-in-part of application No. 15/373,448, filed on Dec. 8, 2016, now abandoned.

(60) Provisional application No. 62/264,451, filed on Dec. 8, 2015.

(51) Int. Cl.
*A45D 24/00* (2006.01)
*A45D 24/04* (2006.01)

(52) U.S. Cl.
CPC ..... *A45D 24/04* (2013.01)

(58) Field of Classification Search
CPC . A45D 2/02; A45D 2/002; A45D 2/42; A45D 2/025; A45D 2/2457; A45D 2/2471; A45D 24/04; A45D 24/08; A45D 24/36; A45D 24/38; Y10T 16/476; Y10T 16/496; A46B 5/002; A46B 5/003; A46B 5/005; A46B 5/0054; A46B 5/0075; A46B 7/004
USPC ..... 15/172
See application file for complete search history.

(56) References Cited

U.S. PATENT DOCUMENTS

| | | | | |
|---|---|---|---|---|
| 1,248,674 | A * | 12/1917 | Kornstein | A45D 2/002 132/117 |
| 1,998,661 | A * | 4/1935 | Eberhard | A45D 2/002 132/125 |
| 3,690,331 | A * | 9/1972 | Messer | A45D 24/16 132/120 |
| 5,458,108 | A | 10/1995 | Jacobs | |
| 5,996,593 | A | 12/1999 | Horman | |
| 6,823,874 | B2 | 11/2004 | Lexcen | |
| 8,353,076 | B1 * | 1/2013 | Asta | A46B 7/02 132/120 |
| 2006/0124149 | A1 | 6/2006 | Salibury et al. | |

* cited by examiner

*Primary Examiner* — Rachel R Steitz
(74) *Attorney, Agent, or Firm* — David J. Kreher

(57) ABSTRACT

The detangling hair comb comprises curved hair teeth to conform to the shape of men and women with curly, wavy or kinky hair types. Even for those with a straight hair type, the curved hair teeth work with the hair shaft, instead of plowing through the hair and ripping hair strands away. Thus, its use reduces or eliminates hair breakage, tangles and tears. The detangling hair comb makes the impossible possible with now easy to maintain healthy hair and scalp for all hair types, including those of the artificial or synthetic hair market. The detangling hair comb may also be used on animals to produce a stress-free grooming experience.

6 Claims, 5 Drawing Sheets

DETANGLING HAIR COMB

CROSS-REFERENCE TO RELATED APPLICATIONS

| | | |
|---|---|---|
| 15/373,448 | Dec. 8, 2016 | Johnson |
| 62,264,451 | Dec. 8, 2015 | Johnson |

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

Field of the Invention

This application relates to detangling hair comb for all sexes, in particular, to a hair comb with curved teeth that do not detach hair strands or hair-like material in the traditional pulling or combing motion.

Background of the Invention

This application is a continuation-in-part of U.S. patent application Ser. No. 15/373,448, filed Dec. 8, 2016, which is a conversion of U.S. Provisional Patent Application No. 62/264,451 filed Dec. 8, 2015 from a provisional to a non-provisional patent application. The benefit of the earlier filing date of the aforementioned U.S. U.S. patent application Ser. No. 15/373,448 and Provisional Patent Application No. 62/264,451 is hereby claimed.

The hair comb and hair clip styling tools mentioned here are commonly used for the cleaning and styling of human hair, and other grooming purposes. However, the present invention can be distinguished from the state of the art.

In U.S. Pat. No. 5,458,108, Jacob reveals an arced or curved body with straight teeth. Due to the angular nature of the hair comb body, this hair comb's purpose or function is to grip and hold in place parts of hair. Jacobs also states the hair comb can also be utilized as a fashion accessory due to its various decorative features.

Along the same lines of being used in a like manner for human hair grooming, is U.S. Pat. No. 5,996,593 Horman reveals a hair clip, that essentially performs the same function as does U.S. Pat. No. 5,445,108. The clamping arms described in Horman are an additional feature of this hair clip. It's gripping ability, would appear to hold in place, more of a marked or parted section of hair, in a more secure manner than Jacob.

For U.S. Patent Application Number 2006/0124149, Salisbury reveals a hair clip with its primary function is to grip and to hold sections of human hair in place without interfering with other hair placement or style, or head movement.

U.S. Pat. No. 6,823,874, Lexcen reveals a hair comb wherein the small sets of hair comb teeth are curved, but are used to manipulate or assemble human hair strands into a curled or ringlet manner. This type of hair comb can also be adapted to operate with a heating element, such as a hand-held dryer or hair curling iron or instrument. The curved, narrow set of hair comb teeth of this comb manipulation and use result in small curls or sets of curls of only thin or fine human hair.

The present disclosure reveals a detangling hair comb with a singular set of curved or angular teeth for use in detangling hair, which works with, not against, hair strands to minimize disruption, tearing, pulling, tangling, shredding and loss of hair. It does not function as a fashion accessory, but, rather acts as a yielding, productive hair styling tool, resulting in less scalp damage and in healthy human hair. Further, the spacing of the hair comb teeth allow minimum disruption or shedding of hair. This hair comb then produces a smooth grooming operation more than suitable for human, animal and artificial hair or hair-like usage.

This detangling hair comb singular set of wide-space curved teeth, can be used not only for personal, human grooming purposes, but, also, for animals and static models with fur, or manufactured hair-like materials or animal body coverings.

SUMMARY OF THE INVENTION

Regardless of the type of hair comb used, a user can often find it difficult to comb hair due to a variety of factors. These include resistance to the pulling motion involved, hair being tangled, or hair becoming bunched up or scrunched down. Further, during the hair combing or grooming process hair may experience tearing, splitting, and breakage, These issues can result from the simple act of not combing hair with the proper or best fitted hair comb for one's hair texture. Specifically, combing one's hair with a bomb made with straight teeth results in hair strands being torn or pulled apart or split as the hair comb teeth rake threw the hair or hair-like material. It is evident that some hair breakage and some hair loss cannot be avoided when using a hair comb made with straight teeth. Thus, the user, even with the use of hair maintenance applications such as conditioner still suffers pain in the hair combing process, hair breakage, and hair loss. The hair breakage and hair loss in particular can lead to hair disease, scalp damage and ultimately, to unhealthy hair, unhealthy scalp and to an unhealthy self-image.

An obvious advantage of this detangling hair comb is, with the use of curved or angular teeth, hair strands are not deliberately pulled apart or jerked at during the hair combing process. Rather, the set of curved hair teeth caresses the hair stands. No longer does the hair combing process operate in a destructive, controlling and breakage fashion. Hair breakage is prevented, hair loss is minimized and hair care is easy with this detangling hair comb's set of curved teeth.

Note that the benefits of the singular curved teeth feature, apply not only to human hair consumers but to the animal kingdom as well and to the manufactured or synthetic and artificially made hair-like materials or coverings.

DETAILED DESCRIPTION OF THE INVENTION

Figure 1:
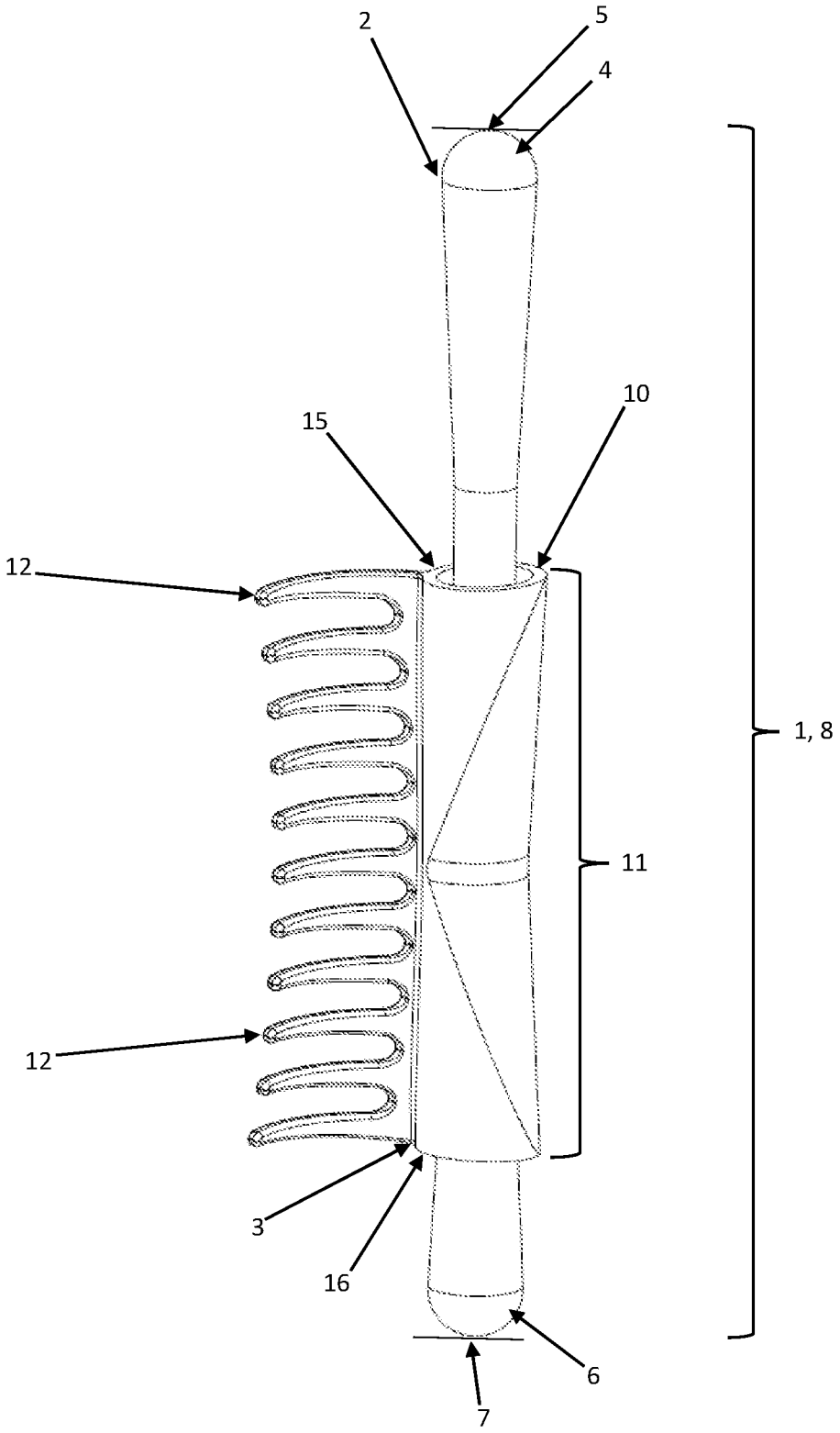
FIG. 1 shows main elements of the detangling hair comb including the handle and comb portion, including the curved teeth.
Figure 2:
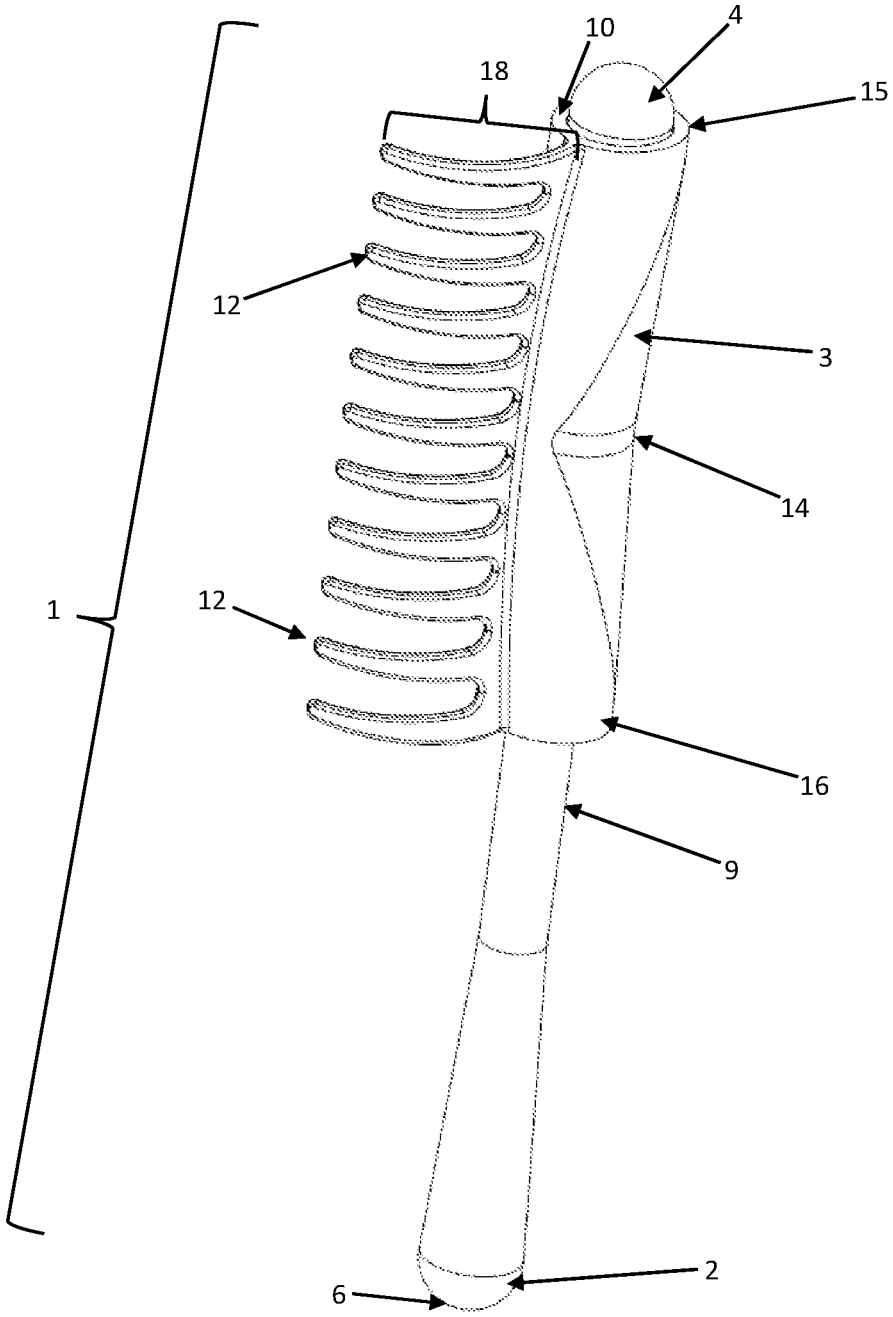
FIG. 2 shows a full, rear view of detangling hair comb.
Figure 3:
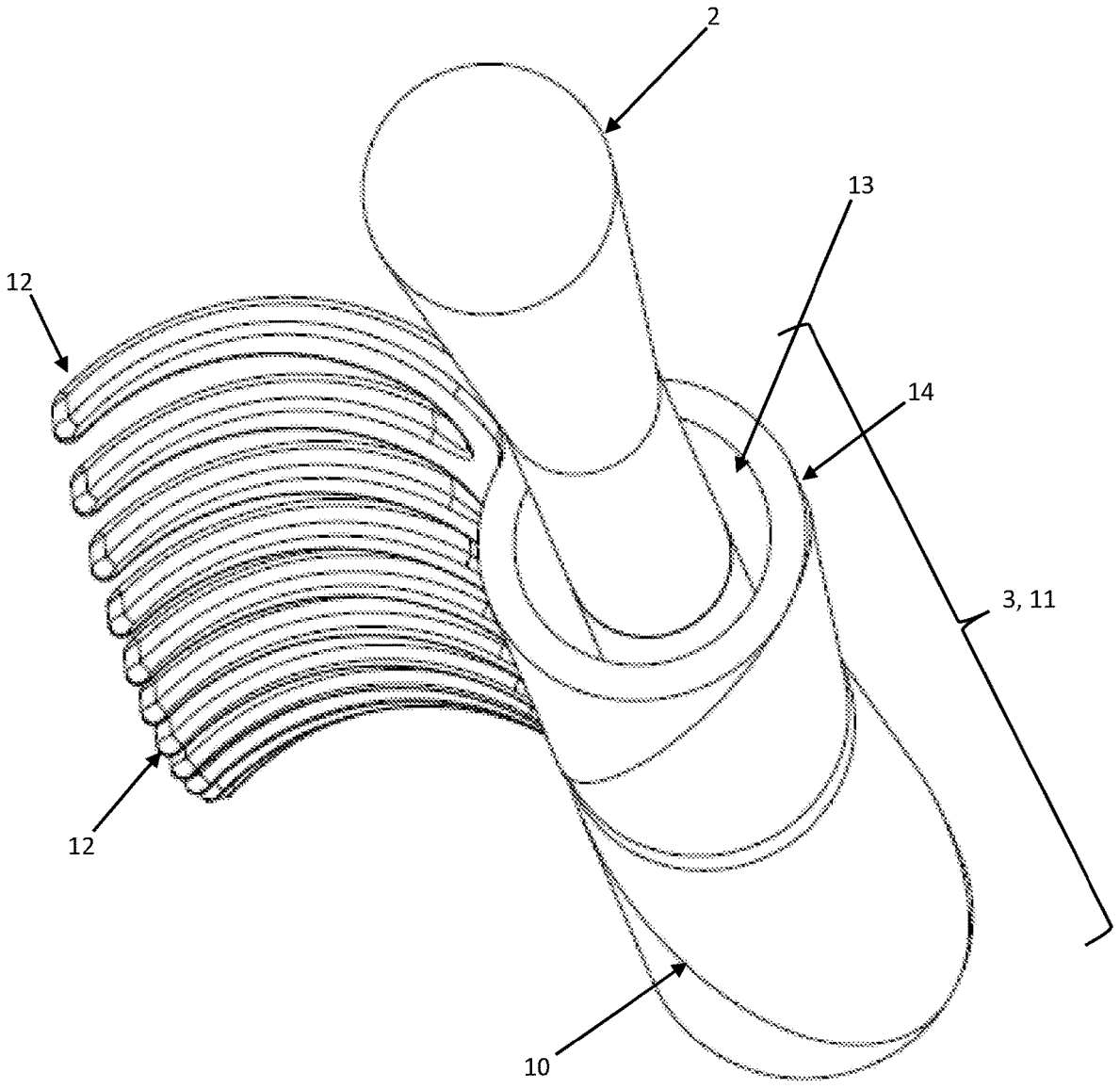
FIG. 3 show an expanded view of the comb portion.
Figure 4:
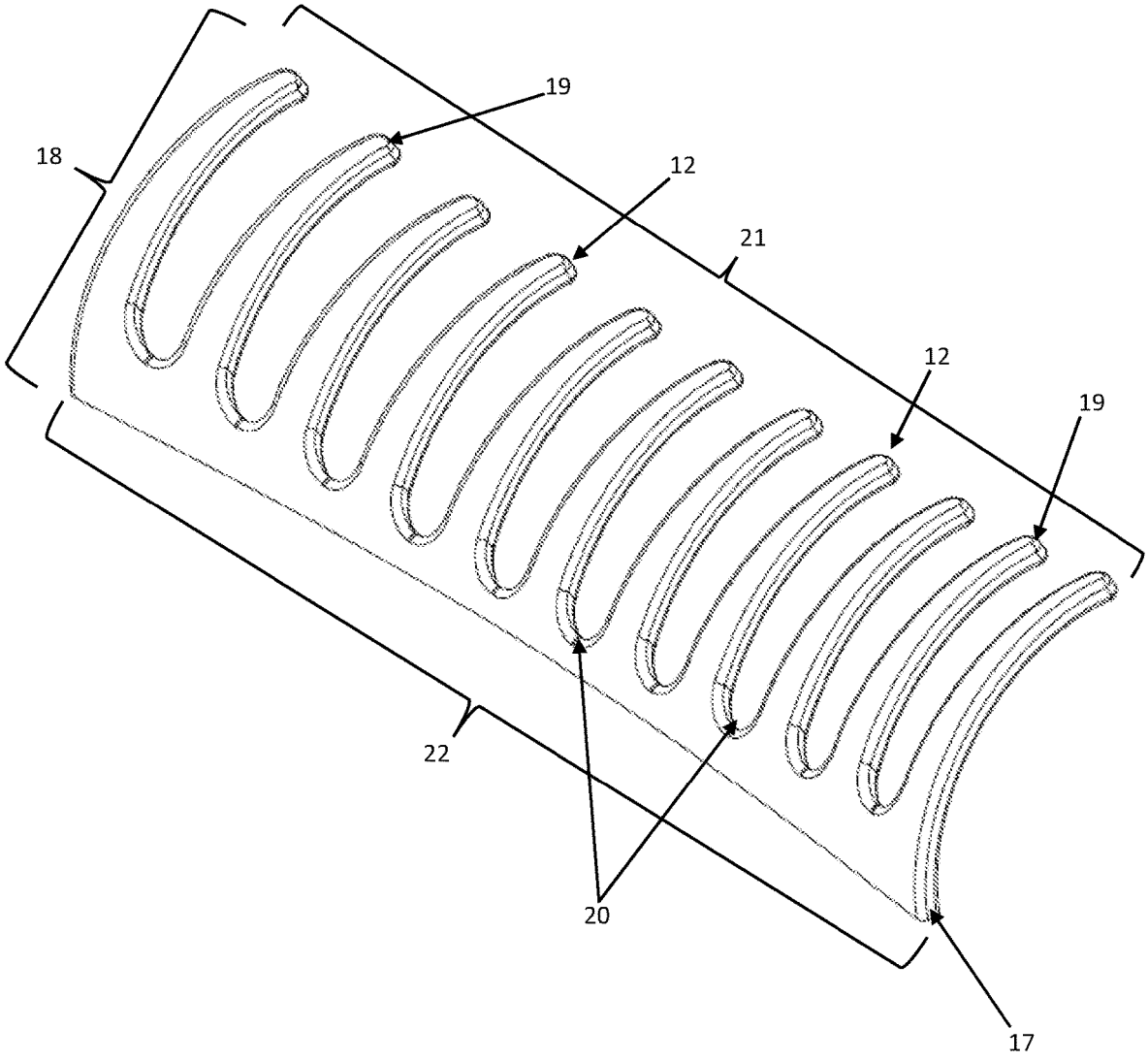
FIG. 4 shows blown up view set of comb teeth.
Figure 5A:
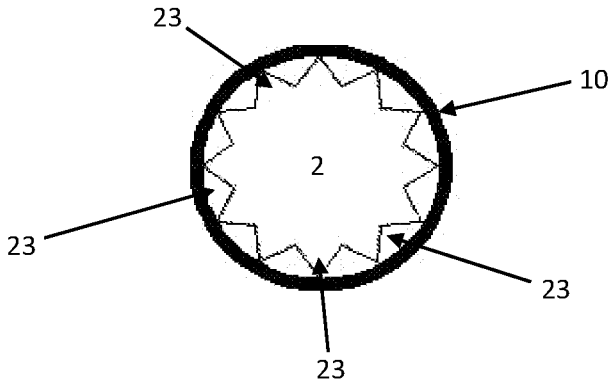
FIG. 5A is a partial display the first end of the handle and the end alpha of the comb portion, including the teeth of the first end and the teeth of the end alpha.
Figure 5B:
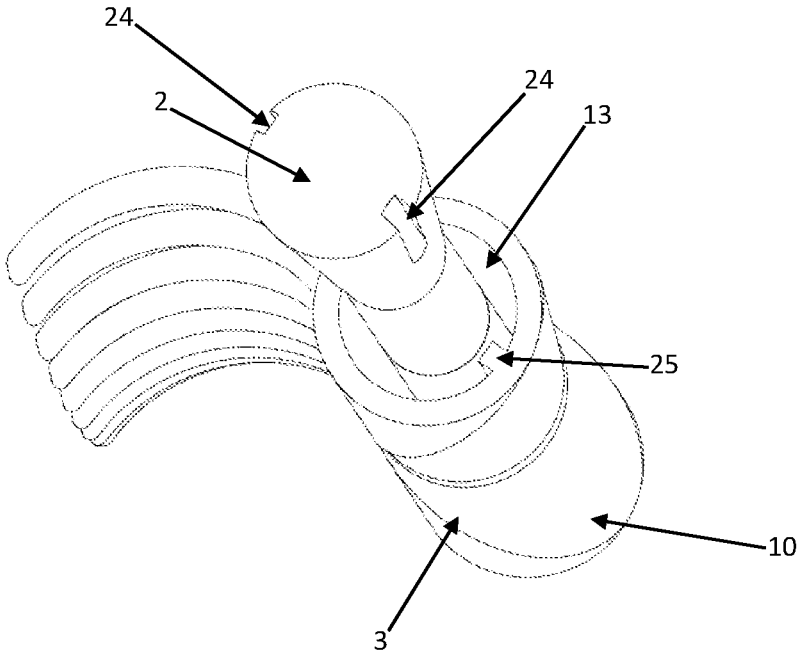
FIG. 5B is a partial display the first end of the handle and the end alpha of the comb portion, including the channel of the first end and the key of the end alpha.

The present disclosure reveals a detangling hair comb 1 that prevents hair breakage, hair pulling, and hair loss, said detangling hair comb 1 comprising a handle 2 and a comb portion 3. The handle 2 comprises a first end 4, a size of the first end 5, a second end 6, a size of the second end 7, a length 8, and a middle 9. The shape of the first end 4 and the shape of the second end 6 comprise a geometric shape. The handle 2 further tapering from the first end 5 toward the middle 9 and tapering from the second end 6 toward the middle 9.

The comb portion 3 comprises an enclosure 10, a length 11, and a plurality of teeth 12. The length 11 of the comb portion 3 is less than the length 8 of the handle 2. The enclosure 10 of the comb portion 3 comprises an interior 13, an exterior 14, an end alpha 15 and an end beta 16. The shape of the interior 13 of the enclosure 10 being such that the handle 2 fits into the interior 13 of the enclosure 10, with the tapering of the handle 2 allowing the comb portion 3 to be easily repositioned at the first end 4 of the handle 2 or the second end 6 of the handle 2 by sliding the comb portion 3 along the length 8 of the handle 2. The shape and size of the first end 4 of the handle 2 matches the shape and size of the interior 13 of the enclosure 10 of the end alpha 15 of the comb portion 3, such that, when the comb portion 3 is at the first end 4 of the handle 2, the shape and size of the first end 4 of the handle 2 locks with the shape and size of the interior 13 of the enclosure 10 of the end alpha 15 of the comb portion 3, and the shape and size of the second end 6 of the handle 2 matches the shape and size of the interior 13 of the enclosure 10 of the end beta 16 of the comb portion 3, such that, when the comb portion 3 is at the second end 6 of the handle 2, the shape and size of the second end 6 of the handle 2 locks with the shape and size of the interior 13 of the enclosure 10 of the end beta 16 of the comb portion 3.

Each tooth of the plurality of teeth 12 of the comb portion 3 comprises an attachment end 17, a length 18, and a point 19. Each tooth of the plurality of teeth 12 is also curved from the attachment end 17, along the length 18 of the tooth to the point 19. The attachment end 17 of each tooth of the plurality of teeth 12 being attached to the enclosure 10 of the comb portion 3 along the length 11 of the comb portion 3. There is also a space 20 between each tooth of the plurality of teeth 12 and the adjacent tooth.

In addition to each tooth of the plurality of teeth 12 being curved from the attachment end 17 to the point 19, the plurality of teeth 12 may also be in a fan pattern 13 such that there is a length 21 along the plurality of teeth 12 at the points 19 of the plurality of teeth 12 and a length 22 at the attachment end 17 of the plurality of teeth 12 along the length 11 of the comb portion 3 and the length 21 along the plurality of teeth 12 at the points 19 of the plurality of teeth 12 is greater than the length 22 at the attachment end 17 of the plurality of teeth 12 along the length 11 of the comb portion 3.

In addition to the above disclosure there may be a plurality of teeth 23 on the first end 4 of the handle 2 and a plurality of teeth 23 on the interior 13 of the end alpha 15 of the enclosure 10, such that, when the comb portion 3 is positioned at the first end 4 of the handle 2 the plurality of teeth 23 of the first end 4 and the plurality of teeth 23 at the end alpha 15 of the enclosure 10 lock together to prevent the comb portion 3 from spinning around the handle 2 when the detangling hair comb 1 is in use. Moreover, there may be a plurality of teeth 23 on the second end 6 of the handle 2 and a plurality of teeth 23 on the interior 13 of the end beta 16 of the enclosure 10, such that, when the comb portion 3 is positioned at the second end 6 of the handle 2 the plurality of teeth 23 of the second end 6 and the plurality of teeth 23 at the end beta 16 of the enclosure 10 lock together to prevent the comb portion 3 from spinning around the handle 2 when the detangling hair comb 1 is in use.

As an alternative to the above disclosure involving teeth to lock the handle and the comb portion together, there may be a plurality of channels 24 on the first end 4 of the handle 2 and a plurality of keys 25 on the interior 13 of the end alpha 15 of the enclosure 10, such that, when the comb portion 3 is positioned at the first end 4 of the handle 2 the plurality of channels 24 of the first end 4 and the plurality of keys 25 at the end alpha 15 of the enclosure 10 lock together to prevent the comb portion 3 from spinning around the handle 2 when the detangling hair comb 1 is in use. Moreover, there may be a plurality of channels 24 on the second end 6 of the handle 2 and a plurality of keys 25 on the interior 13 of the end beta 16 of the enclosure 10, such that, when the comb portion 3 is positioned at the second end 6 of the handle 2 the plurality of channels 24 of the second end 6 and the plurality of keys 25 at the end beta 16 of the enclosure 10 lock together to prevent the comb portion 3 from spinning around the handle 2 when the detangling hair comb 1 is in use.

What is claimed:

1. A detangling hair comb for detangling and smooth hairing, said detangling hair comb comprising:

a handle and a comb portion;

the handle comprising a first end, a size of the first end, a second end, a size of the second end, a length, and a middle;

the shape of the first end and the second end comprising a geometric shape;

the handle further tapering from the first end toward the middle and tapering from the second end toward the middle;

the comb portion comprising an enclosure, a length, and a plurality of teeth;

the length of the comb portion being less than the length of the handle;

the enclosure of the comb portion comprising an interior, an exterior, an end alpha and an end beta;

the shape of the interior of the enclosure being such that the handle fits into the interior of the enclosure, with the tapering of the handle allowing the comb portion to be easily repositioned at the first end of the handle or the second end of the handle by sliding the comb portion along the length of the handle;

the shape and size of the first end of the handle matches the shape and size of the interior of the enclosure of the end alpha of the comb portion, such that, when the comb portion is at the first end of the handle, the shape and size of the first end of the handle locks with the shape and size of the interior of the enclosure of the end alpha of the comb portion, and the shape and size of the second end of the handle matches the shape and size of the interior of the enclosure of the end beta of the comb portion, such that, when the comb portion is at the second end of the handle, the shape and size of the second end of the handle locks with the shape and size of the interior of the enclosure of the end beta of the comb portion;

each tooth of the plurality of teeth of the comb portion comprising an attachment end, a length, and a point;

wherein each tooth of the plurality of teeth is curved from the attachment end, along the length of the tooth to the point;

the attachment end of each tooth of the plurality of teeth being attached to the enclosure of the comb portion along the length of the comb portion; and wherein there is a space between each tooth of the plurality of teeth and the adjacent tooth.

2. The detangling hair comb of claim 1 further comprising a plurality of teeth on the first end of the handle and a plurality of teeth on the interior of the end alpha of the enclosure, such that, when the comb portion is positioned at the first end of the handle the plurality of teeth of the first end and the plurality of teeth at the end alpha of the enclosure lock together to prevent the comb portion from spinning around the handle when the detangling hair comb is in use; and a plurality of teeth on the second end of the handle and a plurality of teeth on the interior of the end beta of the enclosure, such that, when the comb portion is positioned at the second end of the handle the plurality of teeth of the second end and the plurality of teeth at the end beta of the enclosure lock together to prevent the comb portion from spinning around the handle when the detangling hair comb is in use.

3. The detangling hair comb of claim 1 further comprising a plurality of channels on the first end of the handle and a plurality of keys on the interior of the end alpha of the enclosure, such that, when the comb portion is positioned at the first end of the handle the plurality of channels of the first end and the plurality of keys at the end alpha of the enclosure lock together to prevent the comb portion from spinning around the handle when the detangling hair comb is in use; and a plurality of channels on the second end of the handle and a plurality of keys on the interior of the end beta of the enclosure, such that, when the comb portion is positioned at the second end of the handle the plurality of channels of the second end and the plurality of keys at the end beta of the enclosure lock together to prevent the comb portion from spinning around the handle when the detangling hair comb is in use.

4. The detangling hair comb of claim 1 wherein the plurality of teeth of the comb portion are in a fan pattern such that there is a length along the plurality of teeth at the points of the plurality of teeth and a length at the attachment end of the plurality of teeth along the length of the comb portion and the length along the plurality of teeth at the points of the plurality of teeth is greater than the length at the attachment end of the plurality of teeth along the length of the comb portion.

5. The detangling hair comb of claim 4 further comprising a plurality of teeth on the first end of the handle and a plurality of teeth on the interior of the end alpha of the enclosure, such that, when the comb portion is positioned at the first end of the handle the plurality of teeth of the first end and the plurality of teeth at the end alpha of the enclosure lock together to prevent the comb portion from spinning around the handle when the detangling hair comb is in use; and a plurality of teeth on the second end of the handle and a plurality of teeth on the interior of the end beta of the enclosure, such that, when the comb portion is positioned at the second end of the handle the plurality of teeth of the second end and the plurality of teeth at the end beta of the enclosure lock together to prevent the comb portion from spinning around the handle when the detangling hair comb is in use.

6. The detangling hair comb of claim 4 further comprising a plurality of channels on the first end of the handle and a plurality of keys on the interior of the end alpha of the enclosure, such that, when the comb portion is positioned at the first end of the handle the plurality of channels of the first end and the plurality of keys at the end alpha of the enclosure lock together to prevent the comb portion from spinning around the handle when the detangling hair comb is in use; and a plurality of channels on the second end of the handle and a plurality of keys on the interior of the end beta of the enclosure, such that, when the comb portion is positioned at the second end of the handle the plurality of channels of the second end and the plurality of keys at the end beta of the enclosure lock together to prevent the comb portion from spinning around the handle when the detangling hair comb is in use.

* * * * *